US009510395B2

(12) United States Patent
Coulton et al.

(10) Patent No.: US 9,510,395 B2
(45) Date of Patent: Nov. 29, 2016

(54) HEATER FOR A HAND HELD APPLIANCE

(71) Applicant: Dyson Technology Limited, Wiltshire (GB)

(72) Inventors: Robert Mark Brett Coulton, Bristol (GB); Robert Lawrence Tweedie, Swindon (GB); James Richard Warren Hewitt, Swindon (GB); Patrick Joseph William Moloney, Swindon (GB)

(73) Assignee: DYSON TECHNOLOGY LIMITED, Wiltshire (GB)

( * ) Notice: Subject to any disclaimer, the term of this patent is extended or adjusted under 35 U.S.C. 154(b) by 184 days.

(21) Appl. No.: 14/331,755

(22) Filed: Jul. 15, 2014

(65) Prior Publication Data

US 2015/0021314 A1 Jan. 22, 2015

(30) Foreign Application Priority Data

Jul. 16, 2013 (GB) ..... 1312680.0

(51) Int. Cl.

| | |
|---|---|
| ***H05B 3/44*** | (2006.01) |
| ***A45D 20/38*** | (2006.01) |
| ***H05B 3/14*** | (2006.01) |
| ***F24H 3/04*** | (2006.01) |
| ***H05B 1/02*** | (2006.01) |

(Continued)

(52) U.S. Cl.

CPC ..... *H05B 3/44* (2013.01); *A45D 20/38* (2013.01); *F24H 3/0423* (2013.01); *H05B 1/0252* (2013.01); *H05B 3/12* (2013.01); *H05B 3/14* (2013.01); *H05B 3/16* (2013.01); *H05B 2203/014* (2013.01); *H05B 2203/022* (2013.01)

(58) Field of Classification Search

None

See application file for complete search history.

(56) References Cited

U.S. PATENT DOCUMENTS 3,094,606 A * 6/1963 Ferris ..... B44D 3/168 219/228
3,610,881 A * 10/1971 Stewart ..... F24H 3/0423 219/400

(Continued)

FOREIGN PATENT DOCUMENTS

EP 2 000 042 12/2008
EP 2 693 610 2/2014

(Continued)

OTHER PUBLICATIONS

Search Report dated Jan. 8, 2014, directed to GB Application No. 1312680.0; 1 page.

(Continued)

*Primary Examiner* — Joseph M Pelham

(74) *Attorney, Agent, or Firm* — Morrison & Foerster LLP

(57) ABSTRACT

A heater for a hand held appliance, the heater comprising a first layer, a second layer and a separator for separating the first and second layers of the heater wherein the separator is a tube. The first layer and/or second layer may be a wire element. The first layer may extend at least partially around and/or partially along the tube. The tube may comprise spacers extending along the tube and radially away from the tube for supporting the first layer. An outer tube may be provided wherein the outer tube extends at least around and along the first layer. The outer tube may extend around and along the tube. An inner support structure for supporting the second layer may be provided. The inner support structure may comprise an inner tube or support wings and the second layer may extend at least partially around the inner tube or support wings.

37 Claims, 8 Drawing Sheets

(51) Int. Cl.
*H05B 3/12* (2006.01)
*H05B 3/16* (2006.01)

(56) References Cited

U.S. PATENT DOCUMENTS

| | | | | | |
|---|---|---|---|---|---|
| 4,122,329 | A * | 10/1978 | Godel | A45D 20/10 | 219/541 |
| 4,167,660 | A * | 9/1979 | Liedtke | H01H 19/56 | 200/567 |
| 4,300,280 | A * | 11/1981 | Majthan | A45D 20/38 | 219/546 |
| 4,350,872 | A | 9/1982 | Meywald et al. | | |
| 4,357,521 | A * | 11/1982 | Ohnmacht | H05B 3/16 | 219/532 |
| 4,667,086 | A * | 5/1987 | Keefe | H05B 3/46 | 219/532 |
| 4,683,370 | A * | 7/1987 | Petersen | F24H 3/0423 | 34/667 |
| 4,757,183 | A * | 7/1988 | Karey | A45D 20/10 | 219/543 |
| 4,767,914 | A | 8/1988 | Glucksman | | |
| 5,875,562 | A | 3/1999 | Fogarty | | |
| 6,222,988 | B1 * | 4/2001 | Behrendt | A45D 20/12 | 219/541 |
| 6,370,326 | B2 * | 4/2002 | Cheng | F24H 3/0423 | 392/384 |
| 8,119,954 | B2 * | 2/2012 | Vissa | H05B 3/44 | 219/535 |
| 9,144,286 | B2 * | 9/2015 | Courtney | A45D 20/00 | |
| 2005/0069303 | A1 * | 3/2005 | Maione | A45D 20/10 | 392/385 |
| 2006/0075654 | A1 | 4/2006 | Lin | | |
| 2007/0047930 | A1 * | 3/2007 | Cafaro | A45D 20/12 | 392/385 |
| 2007/0294909 | A1 * | 12/2007 | Abdi | A45D 20/10 | 34/97 |
| 2010/0008655 | A1 | 1/2010 | Tackitt et al. | | |
| 2010/0064542 | A1 | 3/2010 | Mulvaney et al. | | |
| 2011/0309068 | A1 | 12/2011 | Chen | | |
| 2013/0111777 | A1 | 5/2013 | Jeong | | |
| 2013/0283630 | A1 * | 10/2013 | Courtney | A45D 20/10 | 34/97 |
| 2013/0283631 | A1 * | 10/2013 | Moloney | A45D 20/10 | 34/97 |
| 2015/0020401 | A1 | 1/2015 | Atkinson | | |
| 2015/0093099 | A1 * | 4/2015 | Shelton | A45D 20/12 | 392/380 |
| 2015/0192325 | A1 * | 7/2015 | Takemoto | F24H 3/0423 | 392/385 |

FOREIGN PATENT DOCUMENTS

| | | |
|---|---|---|
| GB | 953057 | 3/1964 |
| GB | 2 034 560 | 6/1980 |
| GB | 2 295 056 | 5/1996 |
| GB | 2500798 | 10/2013 |
| GB | 2506654 | 4/2014 |
| GB | 2513361 | 10/2014 |
| GB | 2513662 | 11/2014 |
| GB | 2516311 | 1/2015 |
| JP | 40-36100 | 12/1965 |
| JP | 48-13744 | 4/1973 |
| JP | 50-152873 | 12/1975 |
| JP | 54-84507 | 6/1979 |
| JP | 54-95813 | 7/1979 |
| JP | 59-161282 | 10/1984 |
| JP | 64-83205 | 3/1989 |
| JP | 2012-45178 | 3/2012 |

OTHER PUBLICATIONS

International Search Report and Written Opinion mailed Sep. 4, 2014, directed to International Application No. PCT/GB2014/051952; 9 pages.

* cited by examiner

HEATER FOR A HAND HELD APPLIANCE

REFERENCE TO RELATED APPLICATIONS

This application claims the priority of United Kingdom Application No. 1312680.0, filed Jul. 16, 2013, the entire contents of which are incorporated herein by reference.

FIELD OF THE INVENTION

This invention relates to a heater for a hand held appliance such as a hairdryer or other hair grooming appliance such as a hot styling brush.

SUMMARY OF THE INVENTION

According to a first aspect, the invention provides a heater for a hand held appliance, the heater comprising a first layer, a second layer and a separator for separating the first and second layers of the heater wherein the separator is a tube.

Preferably, the first layer is a wire element. Preferably, the second layer is a wire element.

It is preferred that the first layer extends at least partially around the tube. Preferably, the first layer extends at least partially along the tube.

It is preferred that the tube comprises spacers extending along the tube and radially away from the tube for supporting the first layer. Preferably, the spacers extend orthogonally away from the tube. It is preferred that the spacers include insertion recesses. Preferably, the insertion recesses are substantially uniformly spaced along the length of the spacers. It is preferred that a wire element is located in the insertion recesses.

Preferably, the heater comprises an outer tube wherein the outer tube extends at least around and along the first layer. It is preferred that the outer tube extends around and along the tube.

Also provided is a heater for a hand held appliance, the heater comprising a first layer, a second layer and a separator for separating the first and second layers of the heater wherein the separator is a tube and the first layer extends at least partially around the tube.

Also provided is a heater for a hand held appliance, the heater comprising a first layer, a second layer and a separator for separating the first and second layers of the heater wherein the separator is a tube and the first layer extends at least partially along the tube.

The heater is preferably a double stacked heater having a first layer and a second layer.

Also provided is a heater for a hand held appliance, the heater comprising a first layer, a second layer and a separator for separating the first and second layers of the heater wherein the separator is a tube and the heater is a double stacked heater.

Preferably, the heater comprises an inner support structure for supporting the second layer. It is preferred that the inner support structure comprises an inner tube.

Also provided is a heater for a hand held appliance, the heater comprising a first layer, a second layer, a separator for separating the first and second layers of the heater and an inner support structure for supporting the second layer, wherein the separator is a tube and the inner support structure comprises an inner tube.

Preferably, the tube extends around and at least partially long the inner tube. It is preferred that the tube extends around and along the inner tube. Preferably, the second layer extends at least partially around the inner tube. It is preferred that the second layer extends at least partially along the inner tube.

Preferably, the inner tube comprises inner spacers extending along and radially away from the tube for supporting the second layer.

Preferably, when the inner tube is inserted within the tube, the inner spacers maintain the position of the inner tube within the tube.

Preferably, the inner spacers extend orthogonally away from the inner tube. It is preferred that the inner spacers include insertion recesses. Preferably, the insertion recesses are substantially uniformly spaced along the length of the inner spacers. It is preferred that a wire element is located in the insertion recesses.

Preferably, when the inner tube is inserted in the tube, the wire element is fixed in location in the insertion recesses.

Alternatively, the inner support structure comprises support wings. Preferably, when the inner support structure is inserted within the tube, the support wings maintain the position of the inner support structure within the tube. It is preferred that the support wings extend at least partially along the length of the tube.

Preferably, the support wings include extensions which extend radially towards the tube.

Preferably, the support wings form a generally triangular shape.

Preferably, the support wings include extensions which extend radially from apexes of the generally triangular shape. Preferably, the extensions form a Y shape. Preferably, the second layer is supported by the extensions.

It is preferred that the extensions include insertion recesses for supporting the second layer. Preferably, the insertion recesses are substantially uniformly spaced along the length of the extensions.

It is preferred that the second layer is a wire element and the wire element is located in the insertion recesses.

Preferably, when the inner support structure is inserted in the tube, the wire element is fixed in location in the insertion recesses.

It is preferred that the generally triangular shape is formed from three shaped parts wherein each apex is formed from two of the three shaped parts.

Preferably, the separator is made from an insulating material. It is preferred that the separator is formed from Mica.

Preferably, the first layer and the second layer are formed from different wire elements.

Also provided is a hair care appliance such as a hairdryer or a hot styling brush comprising a heater according to the invention

BRIEF DESCRIPTION OF THE DRAWINGS

The invention will now be described by way of example, with reference to the accompanying drawings, of which.

DETAILED DESCRIPTION OF THE INVENTION

Figure 1:
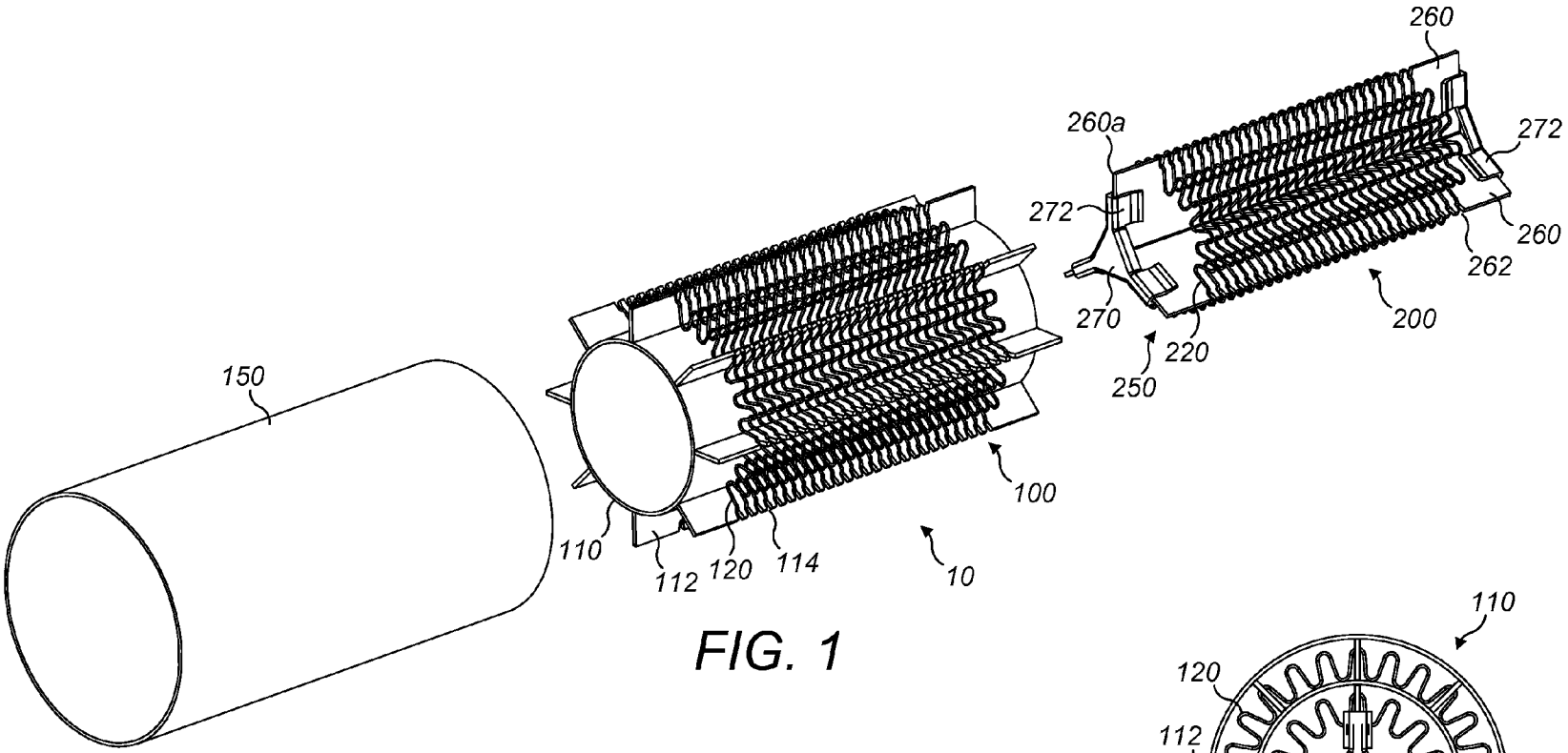
FIG. 1 shows an exploded view of a heater according to the invention.
Figure 2:
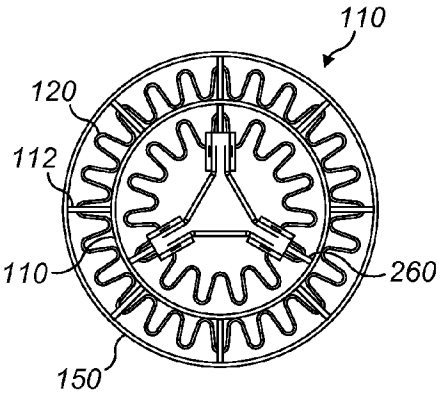
FIG. 2 shows a cross section through a heater of FIG. 1.
Figure 3:
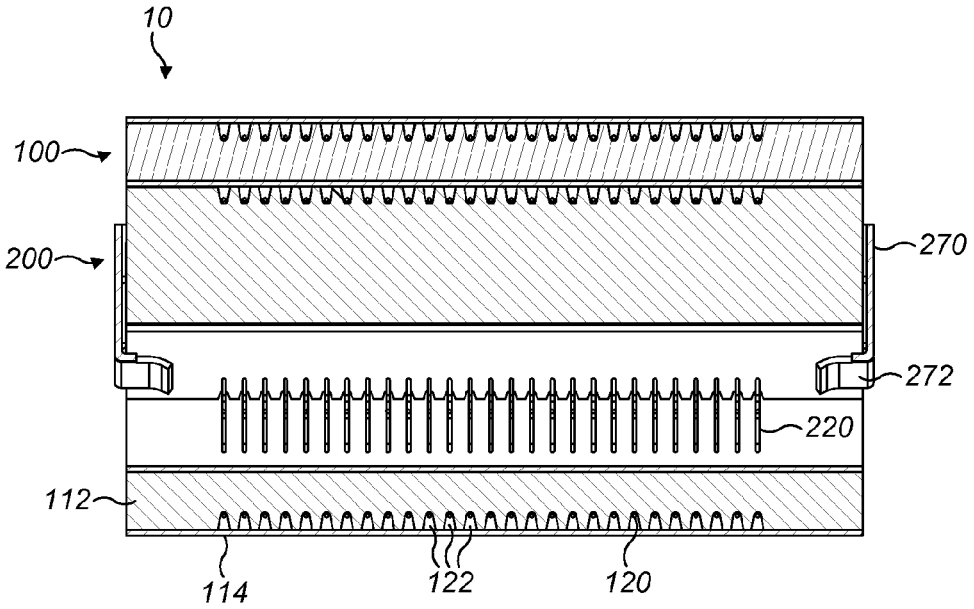
FIG. 3 shows another cross section through the heater of FIG. 1.
Figure 4:
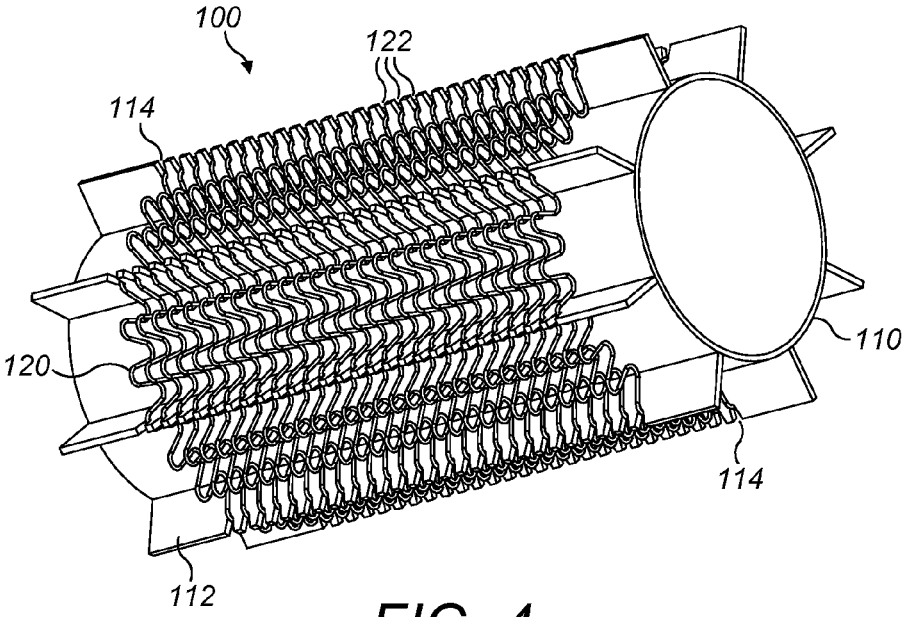
FIG. 4 shows a perspective view of a first layer of a heater.
Figure 5:
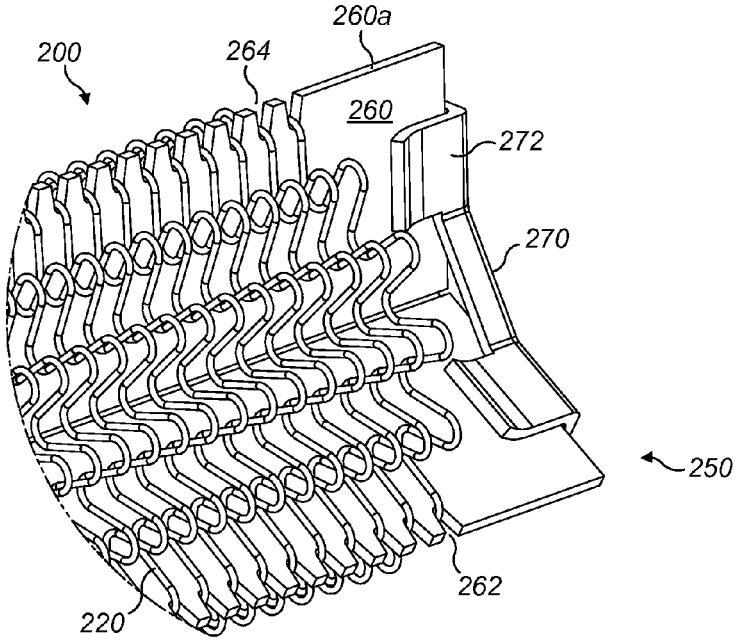
FIG. 5 shows a portion of the second layer of the heater of FIG. 1 in more detail.

Referring to FIGS. 1 to 5, the heater 10 has a first layer 100 and a second layer 200. The first layer 100 includes a tube 110 having a number of spacers 112 which extend radially out from the tube 110. The spacers 112 include insertion recesses 114 into which a heater element 120 is located.

The heater element 120 is a wire made from a suitable material such as Nichrome which is shaped into zig zags or undulations and then wound around the tube 110. The spacers 112 provide support for the heater element 120 as it is wound around the tube 110 and the insertion recesses 114 keep individual coils 122 of the heater element 120 separate from each other. The insertion recesses 114 maintain the spacing between different coils 122 of the heater element reducing the chance of hot spots and restrictions to air or fluid flow through the heater.

The tube 110 and the spacers 112 are formed from an insulating material such as Mica.

Internal of the first layer 100 and tube 110, is a second layer 200. The second layer 200 includes a second heater element 220 which is a wire shaped into zig zags or undulations and wound onto a support structure 250. In this embodiment, the support structure 250 is a tri-support and is geometrically similar to a triangular prism. However other shapes can be used such as a quad or cross shaped support.

The support structure 250 is formed from three rectangular pieces 260 of an insulating material, such as Mica and a pair of end clamps 270. The end clamps 270 hold the three rectangular pieces 260 together so that one long edge 260*a* of each of the rectangular pieces is upstanding 260 and forms an apex of a triangle. This triangle forms the frame around which a wire element 220 is wound.

The end clamps 270 are formed from a shaped piece of metal which has end tabs 272 which are folded one on each side of a rectangular piece 260 to hold it in position.

The rectangular piece 260 has insertion slots 262 extending along the length of the protruding part with the apertures 264 for each slot being disposed along the length of the upstanding long end 260*a* of each of the rectangular pieces 260. The wire element 220 is wound around the rectangular piece 260 and located within the insertion recesses 262. Thus, the rectangular piece 260 provides supports for the wire element 220 along and around the length of the heater element 200.

Figure 6:
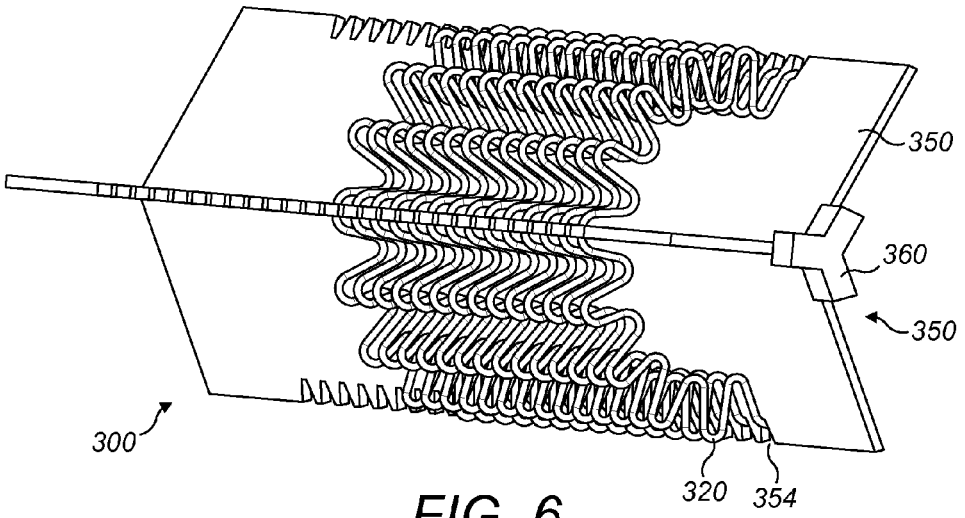
FIG. 6 shows a perspective view of a second layer of a heater.

FIG. 6 shows an alternative second heater layer 300 having a different support structure 350. In this example, the support structure 350 is formed from three insulating sheets 352 formed in a Y shape. A tri support clip 360 is provided at each end of the insulating sheets 352 to retain the angular separation of the insulating sheets. Insertion recesses 354 are disposed along the length of each of the insulating sheets 352 for receiving the wire element 320. The insulating sheets are preferably formed from Mica.

In conventional heaters, the use of a tri-support can be problematic. Although a tri-support provides a more compact heater element than for example a cross shaped support, the relatively larger distance between supporting locations on the wire element produces less tension on the wire element 220, 320 leading to an increased risk that the wire element 220, 320 will move out of an insertion recess to an adjacent recess. This is undesirable as it results in hot spots and premature failure of the heater element can occur. In the embodiments having a tri-support 250, 350 the advantages resultant from using a tri-support are maintained due to the structure of the first layer 100 which surrounds the second layer. As the tri-supported element 220, 320 is housed within the first layer 100, the tube 110 surrounds the second heater element 200, 300 and prevents longitudinal movement of the second wire element 220, 320.

Around the outside of the first layer 100, an outer tube 150 is provided. This outer tube 150 is optional and provides an insulating layer for the heater 10 and whatever houses the heater 10. In addition to insulating the outer surface of the heater 10, the outer tube 150 and prevents longitudinal movement of the individual coils 122 of the first wire element 120 with respect to their insertion recesses 114.

Figure 7:
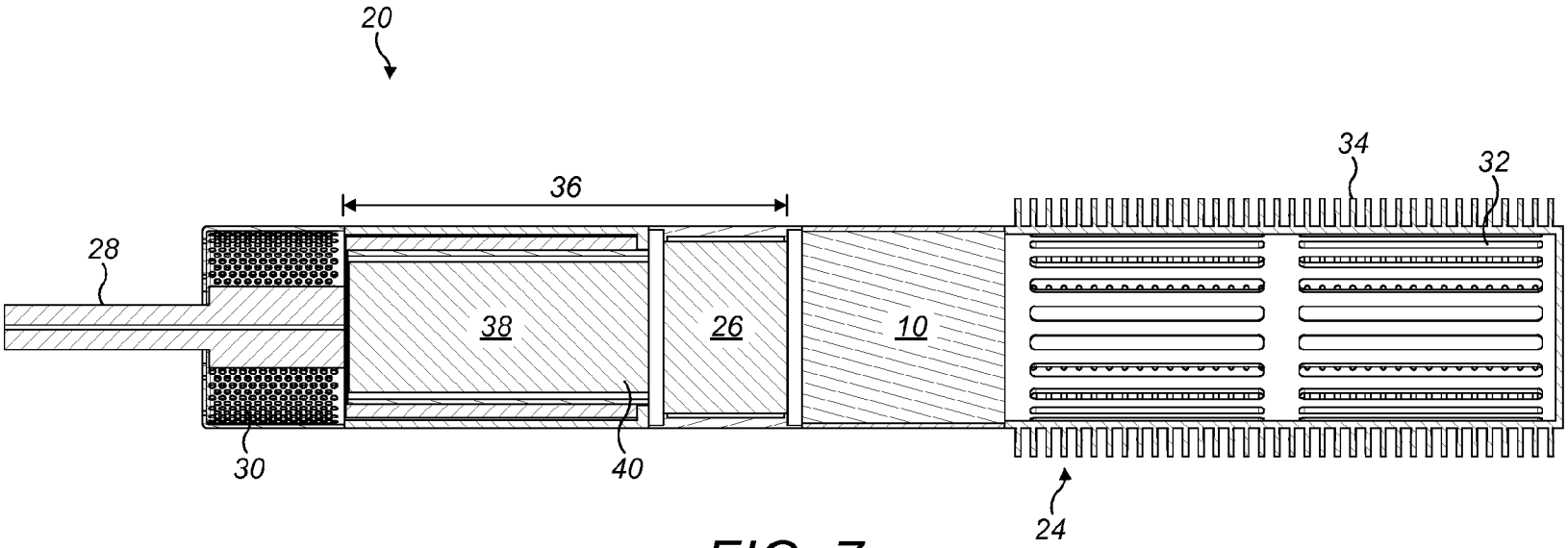
FIG. 7 shows an appliance in which the heater of FIGS. 1 to 6 is used.
Figure 8:
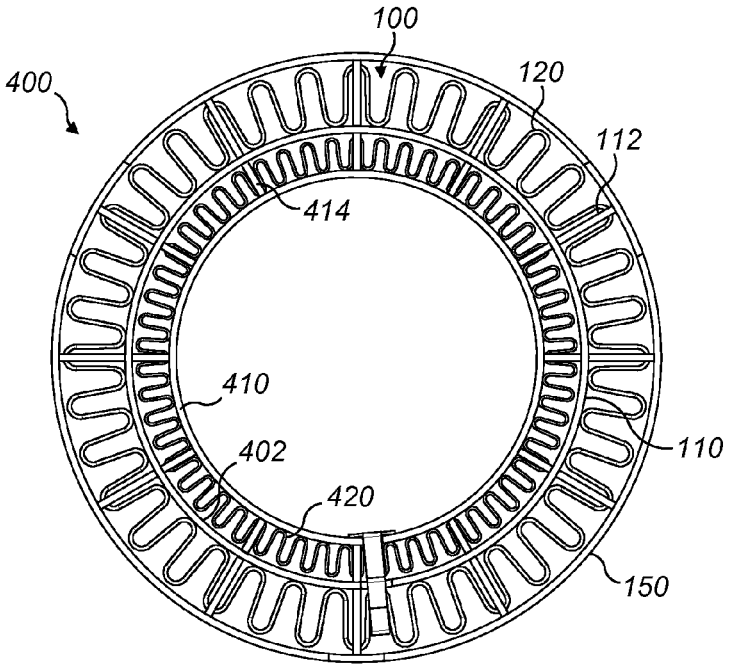
FIG. 8 shows a cross section through an alternative heater according to the invention.
Figure 9:
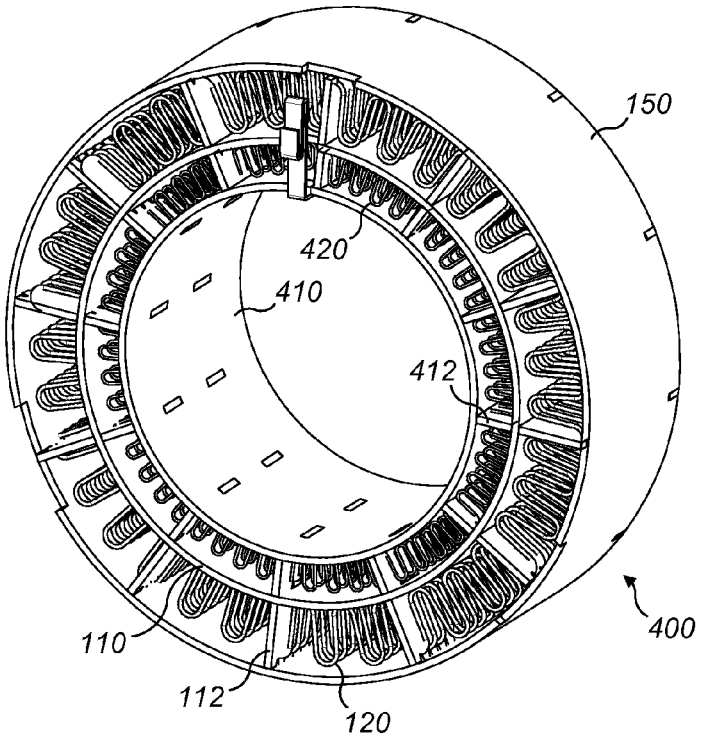
FIG. 9 shows a perspective view of the alternative heater.
Figure 10:
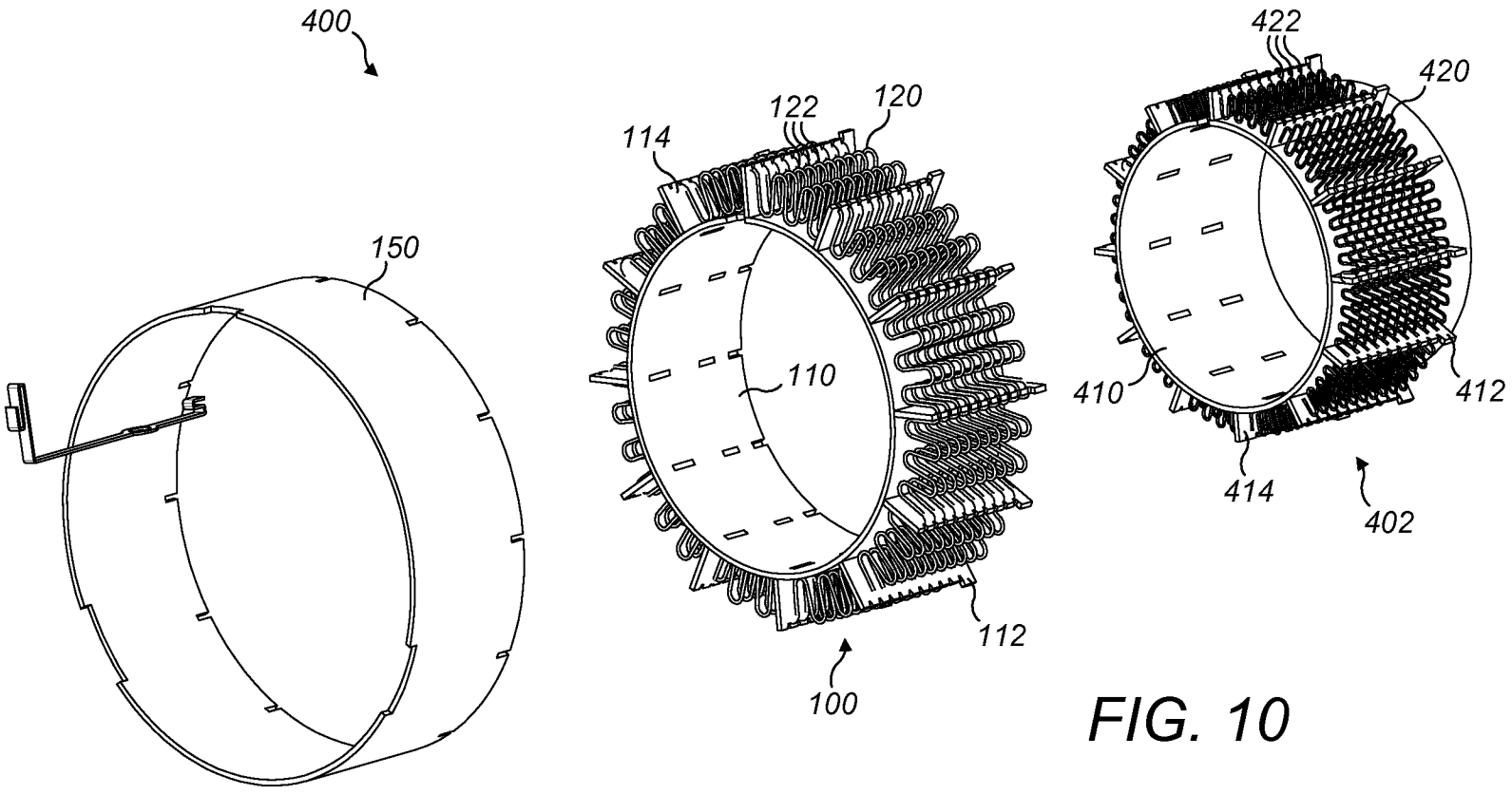
FIG. 10 shows an exploded view of the alternative heater.
Figure 11:
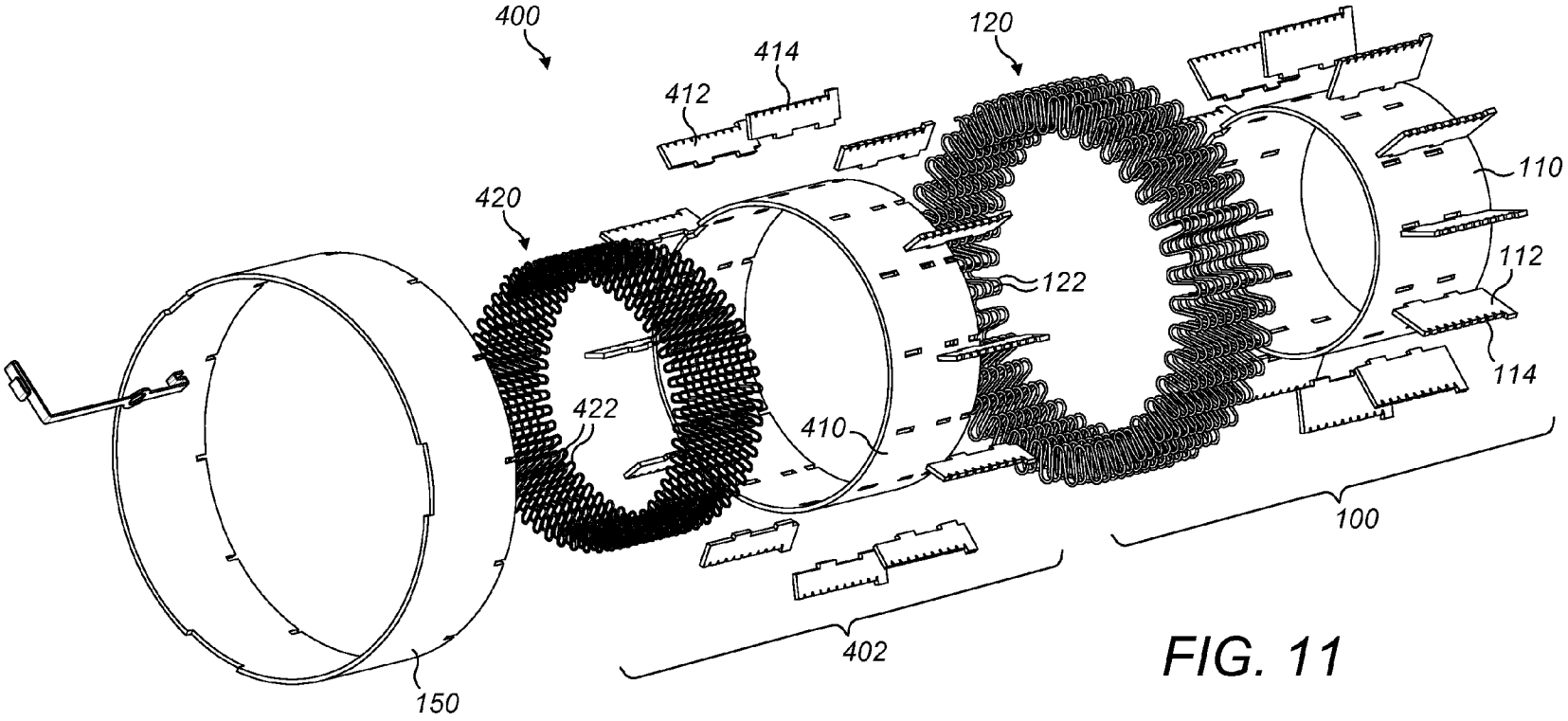
FIG. 11 shows another exploded view of the alternative heater.

FIG. 7 shows a hot styling brush 20 which incorporates a heater 10. The hot styling brush 20 has a body 22 and a styling head 24. The body 22 has an inlet 30 at one end where fluid is drawn into the appliance through the action of a fan unit 26. The fluid is subsequently heated by a heater 10 before entering the head 24.

The head 24 includes a plurality of radially spaced slots 32 which extend longitudinally along the head 24. Between adjacent pairs of slots 32 are a line of bristles 34 so during a styling procedure, the hair is brushed whilst hot fluid passes through the hair, drying and styling the hair.

Power is supplied by a cable 28 which in this example enters the hot styling brush 20 at the inlet 30. Internal wiring (not shown) provides power to the heater 10 and to the fan unit 26 to run a motor that drives the impeller of the fan unit 26.

The body 22 includes a handle portion 36 which extends generally from the inlet 30. The body 22 includes a generally circular fluid flow path 38 from the inlet 30 along the body 22 through the heater 10 and into the head 24. The heater 10 is a double stacked heater having a first layer 100 and a second layer 200, 300. This is advantageous for a number of reasons. Firstly, the fluid that flows through the fluid flow path 38 is heated evenly as the heater elements 120, 220, 320 cover a large proportion of the cross section through the body 22 (See FIG. 2, for example). Second, the heater elements 100, 200, 300 can be powered and controlled separately enabling a variety of temperature of fluid emitted from the head 24. Also, by having a double stacked heater 10, the length of the heater can be reduced compared with a single stack heater providing a more compact component.

In order to enable a variety of temperature and flow rates through the appliance, a PCB 40 is provided. The PCB is electrically connected to both the heater 10 and the fan unit 26 and can vary the power supplied to both. As an example, a user can chose different power and heater settings. The PCB 40 controls the power to each heater layer 100, 200, 300 independently so for low temperature settings, only one heater layer needs to be used. In addition, the speed at which the fan unit 26 is operated can be varied to enable wet hair to be dried quickly initially and then the one or more of the heat and power can be reduced or increased to enable styling.

Each of the first layer 100 and second layer 200,300 can be assembled or constructed separately i.e. the wire element is wound around each layer in a separate process and then the second or inner layer is inserted within the first or outer layer. Each of the first layer 100 and second layer 200,300 are self supporting which assists in this form of assembly.

Alternatively, the first or inner layer is constructed and the same wire element is subsequently wound around the second layer. This results in less internal connections within the appliance but means that the two heater layers will function as a single heater element which could reduce flexibility and control of the temperature range the appliance can output fluid at.

The heater 10 is suitable for use in other heated blowers such as conventional hairdryers and in particular travel appliances where space is at a premium.

FIGS. 8 to 11 show various views of an alternate heater 400. In this embodiment, components illustrated and already described in relation to FIGS. 1 to 6 have like reference numerals. The first heater layer 100 is similar to the one described in reference to FIGS. 1 to 6 but has a larger diameter. The second heater layer 402 is also annular with a cylindrical or tubular support 410. A plurality of spacers 412 extend around and radially away from the cylindrical support 410. The spacers 412 include insertion recesses 414 into which the heater element 420 is located.

The heater element 420 is a wire which is shaped into zig zags or undulations and then wound around the tube 410. The spacers 412 provide support for the heater element 420 as it is wound around the tube 410 and the insertion recesses 414 keep individual coils 422 of the heater element 420 separate from each other.

The tube 410 and the spacers 412 are formed from an insulating material such as Mica.

Figure 12:
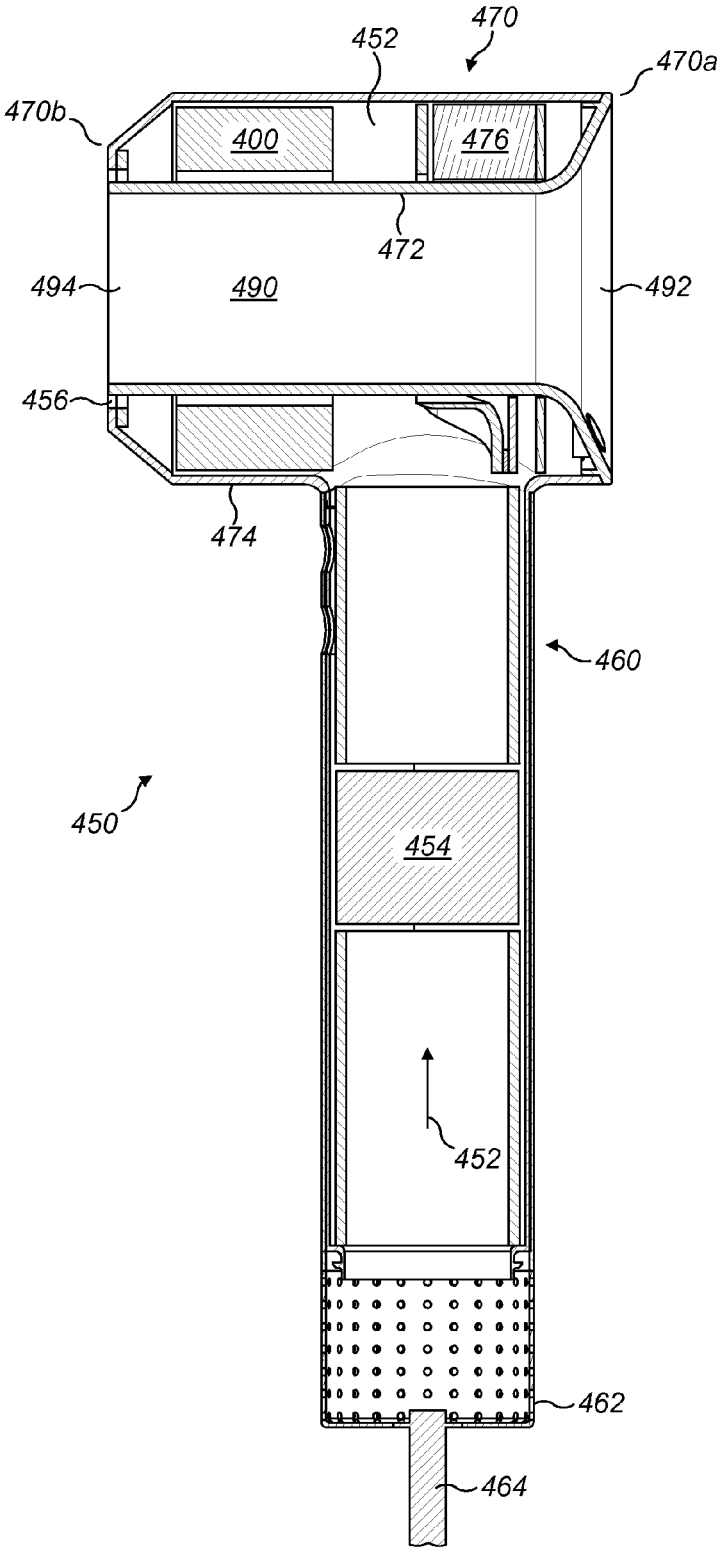
FIG. 12 shows an appliance in which the heater of FIGS. 8 to 11 is used.

FIG. 12 shows a hairdryer 450 which incorporates heater 400. The hairdryer 450 is an amplifying hairdryer where processed flow 452 or that which is drawn into the appliance by the action of a fan unit 454 and optionally heated is augmented or increased by an entrained flow.

The hairdryer 450 has a handle 460 and a body 470. An inlet 462 is provided in the handle 460 at the distal end from the body 470. Fluid is drawn into the inlet 462 by the action of a fan unit 454 and flows within a fluid flow path 452 along the handle 460 from the inlet 462 towards the body 470. The fluid flow path 452 within the handle is generally circular but, within the body it becomes annular.

The body 470 is tubular and has an internal duct 472 which extends along the length of the body 470 from an inlet end 470*a* to an outlet end 470*b*. This duct 472 defines the entrained fluid flow path 490 which flows within the duct 472 from a second inlet 492 to a second outlet 494. The duct 472 and an outer wall 474 of the body 470 define the fluid flow path 452 through the body from the handle 460 towards a fluid outlet 456 of the fluid flow path 452. Within the body 470, a heater 400 is disposed and the heater extends along and around the duct 472 and directly heats fluid flowing in the fluid flow path 452. Fluid flowing through the entrained flow path 490 may be indirectly heated by the heater 400.

In operation, the fan unit 454 draws fluid in through the inlet 462 along the fluid flow path 452 to the body, through the heater 400 and to the fluid outlet 456. The action of this fluid flowing through the hairdryer and out of the fluid outlet 456 causes fluid to be entrained or pulled into the duct 472 at the second inlet 492 and along the entrained fluid flow path 490 towards the second outlet 494.

In this example the processed flow exits from the hairdryer as an annular ring that extends around the entrained flow. Thus the output from the hairdryer is a heated ring of fluid surrounded on both sides by cooler air. As an alternative, the fluid outlet 456 is located within the body 470 and the heated fluid mixes with the entrained flow before the fluid exits from the appliance.

Power is supplied to the hairdryer via a cable 464 which enters the hairdryer 450 at the inlet 462. Internal wiring (not shown) provides power to the heater 400 and the fan unit 454 to run a motor that drives the impeller of the fan unit 454.

In order to provide a variety of temperature and flow rates through the appliance, a PCB 476 is provided. The PCB 476 is electrically connected to both the heater 400 and the fan unit 454 and enables a user to vary power to both. As an example, the user can chose different power and heat settings. The PCB 476 controls the power to each heater layer 100, 400 independently so for low temperature settings, only one heater needs to be used. In addition, the speed of the fan unit 454 can be varied to change the flow through the appliance.

In all of the embodiments shown, the first layer 100 and second layer 200, 300, 402 can be made from a single continuous wire or, as is preferred two separate wires. Each layer can be designed to have the same power output or different power outputs for example, one layer can have twice the power output of the other. The different power outputs can be achieved by various methods that will be apparent to the skilled person and include using wires of different gauge or different length, the same gauge and different length or different gauge and the same length. Layers having the same power output do not need to use the same gauge and length of wire in fact this may be impractical due to the volume constraints of each layer.

The invention claimed is:

1. A heater for a hand held appliance, the heater comprising a first layer, a second layer, a separator for separating the first and second layers of the heater, and an inner support structure for supporting the second layer, wherein the separator is a tube, the first layer comprises a wire element that is wound at least partially around the tube, and the inner support structure comprises an inner tube.

2. The heater of claim 1, wherein the first layer is a wire element.

3. The heater of claim 1, wherein the second layer is a wire element.

4. The heater of claim 1, wherein the first layer extends at least partially along the tube.

5. The heater of claim 1, wherein the tube comprises spacers extending along the tube and radially away from the tube for supporting the first layer.

6. The heater of claim 5, wherein the spacers extend orthogonally away from the tube.

7. The heater of claim 5, wherein the spacers include insertion recesses.

8. The heater of claim 7, wherein the insertion recesses are substantially uniformly spaced along the length of the spacers.

9. The heater of claim 7, wherein the wire element is located in the insertion recesses.

10. The heater of claim 1, comprising an outer tube wherein the outer tube extends at least around and along the first layer.

11. The heater of claim 10, wherein the outer tube extends around and along the tube.

12. The heater of claim 1, wherein the tube extends around and at least partially along the inner tube.

13. The heater of claim 1, wherein the tube extends around and along the inner tube.

14. The heater of claim 1, wherein the second layer extends at least partially around the inner tube.

15. The heater of claim 1, wherein the second layer extends at least partially along the inner tube.

16. The heater of claim 1, wherein the inner tube comprises inner spacers extending along and radially away from the tube for supporting the second layer.

17. The heater of claim 16, wherein when the inner tube is inserted within the tube, the inner spacers maintain the position of the inner tube within the tube.

18. The heater of claim 16, wherein the inner spacers extend orthogonally away from the inner tube.

19. The heater of claim 16, wherein the inner spacers include insertion recesses.

20. The heater of claim 19, wherein the insertion recesses are substantially uniformly spaced along the length of the inner spacers.

21. The heater of claim 19, wherein a wire element is located in the insertion recesses.

22. The heater of claim 21, wherein when the inner tube is inserted in the tube, the wire element is fixed in location in the insertion recesses.

23. The heater of claim 1, wherein the inner support structure comprises support wings.

24. The heater of claim 23, wherein when the inner support structure is inserted within the tube, the support wings maintain the position of the inner support structure within the tube.

25. The heater of claim 23, wherein the support wings extend at least partially along the length of the tube.

26. The heater of claim 23, wherein the support wings include extensions which extend radially towards the tube.

27. The heater of claim 26, wherein the second layer is supported by the extensions.

28. The heater of claim 27, wherein the extensions include insertion recesses for supporting the second layer.

29. The heater of claim 28, wherein the insertion recesses are substantially uniformly spaced along the length of the extensions.

30. The heater of claim 28, wherein the second layer is a wire element and the wire element is located in the insertion recesses.

31. The heater of claim 30, wherein when the inner support structure is inserted in the tube, the wire element is fixed in location in the insertion recesses.

32. The heater of claim 1, wherein the separator is made from an insulating material.

33. The heater of claim 32, wherein the separator is formed from Mica.

34. The heater of claim 3, wherein the first layer and the second layer are formed from different wire elements.

35. A hair care appliance comprising the heater of claim 1.

36. The hair care appliance of claim 35, wherein the hair care appliance is a hairdryer.

37. The hair care appliance of claim 35, wherein the hair care appliance is a hot styling brush.

* * * * *